US007420532B2

(12) United States Patent
Nakajima et al.

(10) Patent No.: US 7,420,532 B2
(45) Date of Patent: Sep. 2, 2008

(54) FLAT DISPLAY APPARATUS AND PORTABLE TERMINAL APPARATUS

(75) Inventors: Yoshiharu Nakajima, Kanagawa (JP); Noboru Toyozawa, Kanagawa (JP)

(73) Assignee: Sony Corporation (JP)

( * ) Notice: Subject to any disclaimer, the term of this patent is extended or adjusted under 35 U.S.C. 154(b) by 500 days.

(21) Appl. No.: 10/541,095

(22) PCT Filed: Dec. 26, 2003

(86) PCT No.: PCT/JP03/16864

§ 371 (c)(1),
(2), (4) Date: Jun. 29, 2005

(87) PCT Pub. No.: WO2004/066247

PCT Pub. Date: Aug. 5, 2004

(65) Prior Publication Data

US 2006/0164353 A1 Jul. 27, 2006

(30) Foreign Application Priority Data

Jan. 22, 2003 (JP) ..... 2003-013461

(51) Int. Cl.
*G09G 5/10* (2006.01)

(52) U.S. Cl. ..... 345/89; 345/690

(58) Field of Classification Search ..... 345/88, 345/89, 690

See application file for complete search history.

(56) References Cited

U.S. PATENT DOCUMENTS 5,228,120 A * 7/1993 Farr et al. ..... 345/593
6,441,758 B1 * 8/2002 Koyama et al. ..... 341/136
6,496,130 B2 * 12/2002 Nagao ..... 341/144
6,788,298 B2 * 9/2004 Kota et al. ..... 345/204
2001/0028336 A1 10/2001 Yamagata et al.
2002/0060656 A1 5/2002 Okuzono
2003/0189541 A1 * 10/2003 Hashimoto ..... 345/89
2003/0231153 A1 * 12/2003 Seong et al. ..... 345/88

FOREIGN PATENT DOCUMENTS

| | | |
|---|---|---|
| JP | 07-260857 | 10/1995 |
| JP | 08-050273 | 2/1996 |
| JP | 08-184813 | 7/1996 |
| JP | 08-334740 | 12/1996 |
| JP | 2000-242209 A | 9/2000 |
| JP | 2000-356782 | 12/2000 |
| JP | 2002-062840 | 2/2002 |
| JP | 2002-156948 | 5/2002 |

OTHER PUBLICATIONS

Austrian Patent Office Search Report; Application No.: 200504011-8; Filing Date: Dec. 26, 2003.
International Search Report mailed Feb. 10, 2004.

* cited by examiner

*Primary Examiner*—Amare Mengistu
*Assistant Examiner*—Robert R Rainey
(74) *Attorney, Agent, or Firm*—Rader Fishman & Grauer PLLC; Ronald P. Kananen

(57) ABSTRACT

The present invention applies illustratively to a liquid crystal display apparatus as well as to a PDA and a mobile phone each using that liquid crystal display apparatus. Typically, a gradation setting circuit 20B for the green color is disposed along one of two opposing sides of a display unit 14, and a gradation setting circuit 20A for the red and blue colors is positioned along the other side of the unit 14.

4 Claims, 9 Drawing Sheets

FLAT DISPLAY APPARATUS AND PORTABLE TERMINAL APPARATUS

TECHNICAL FIELD

The present invention relates to a flat display apparatus and a portable terminal apparatus. More particularly, the invention relates to a liquid crystal display device and to PDA's (Personal Digital Assistants) as well as mobile phones each incorporating the liquid crystal display device. The invention envisages disposing a green gradation setting circuit along one of two opposing sides of the framework for a display unit, and a red and blue gradation setting circuit along the other side of the framework, whereby electric power consumption of the display unit is made lower and its framework more streamlined than before.

BACKGROUND ART

Recent years have seen liquid crystal display devices which, as one type of flat display apparatus applicable in portable terminal device such as PDA's and mobile phones, have liquid crystal display panel driving circuits formed integrally with a glass substrate serving as an insulating substrate constituting part of the liquid crystal display panel.

FIG. 1 is a plan view of one such liquid crystal display device 1. The liquid crystal display device 1 has each of its pixels constituted by a liquid crystal cell, a polysilicon TFT (Thin Film Transistor) acting as the switching device of this liquid crystal cell, and an auxiliary capacitor. The pixels are disposed in a matrix to form a rectangular display unit 2. The liquid crystal display device 1 has horizontal driving circuits 3 and 4 formed parallel to the upper and the lower sides of the display unit 2 respectively, the two sides being located opposite to each other. A vertical driving circuit 5 is disposed parallel to one of the remaining two sides extending vertically.

The horizontal driving circuits 3 and 4 are provided to set color gradations for the odd-numbered and even-numbered columns of pixels in the display unit 2. More specifically, gradation data D1 and D2 for the odd-numbered and even-numbered columns are input to the liquid crystal display device 1 in a raster scan sequence through an input unit 6 disposed on the top of the device. In the horizontal driving circuits 3 and 4, sampling latches 3A and 4A each have a plurality of latching elements which correspond to the pixels in the line direction and which latch input image data cyclically. In this manner, the horizontal driving circuits 3 and 4 get the sampling latches 3A and 4A to hold temporarily the gradation data D1 and D2 on a line-by-line basis, the data being input in the raster scan sequence.

Second latches 3B and 4B are provided to further latch the latched results from the latching elements making up the sampling latches 3A and 4A, the second latching being done concurrently and in parallel at horizontal scanning intervals. The gradation data D1 and D2 are thus brought together on a line-by-line basis for output to level shifters 3C and 4C.

The level shifters 3C and 4C are provided to level-shift the gradation data D1 and D2 output concurrently and in parallel from the second latches 3B and 4B, in such a manner as to drive conductive (N-channel/P-channel) MOS (Metal Oxide Semiconductor) transistors that constitute digital-to-analog converters (DAC) 3D and 4D located downstream. The digital-to-analog converters 3D and 4D generate and output driving voltages corresponding to the gradation data D1 and D2. In the horizontal driving circuits 3 and 4, a plurality of driving voltages thus generated are supplied to the column lines of the display unit 2. This causes the odd-numbered and even-numbered columns to be set cyclically to the driving voltages corresponding to the gradation data D1 and D2 for the vertically continuous pixels.

The vertical driving circuit 5 selects one by one the row lines of the display unit 2 in keeping with the driving voltages set on the column lines, thus activating the TFT's of the corresponding pixels. In this manner, the liquid crystal display device 1 displays desired pictures using the gradation data D1 and D2.

The above type of liquid crystal display device has come to adopt the digital-to-analog converters 3A and 4D, as disclosed illustratively in Japanese Patent Laid-open No. 2000-242209, in order to generate driving voltages by selecting a plurality of reference voltages in accordance with the gradations derived from the gradation data D1 and D2 (this setup is called the reference voltage selection type). In this case, as shown in FIG. 2 in comparison with FIG. 1, a reference voltage generation circuit 7 for generating multiple reference voltages is located parallel to the remaining vertical side of the display unit 2 and equidistant from the horizontal driving circuits 3 and 4. Thus positioned, the reference voltage generation circuit 7 supplies the reference voltages to the two horizontal driving circuits 3 and 4. This layout is intended to suppress variations in the reference voltages for the odd-numbered and even-numbered columns, thereby effectively bypassing vertical streaks that may occur on the display screen due to reference voltage fluctuations.

FIG. 3 is a connection diagram showing the digital-to-analog converters 3D and 4D of the reference voltage selection type. In the digital-to-analog converters 3D and 4D, a plurality of series circuits C0 through C63 are provided corresponding to the gradations in effect, each series circuit being composed of switching circuits turned on and off depending on the logical values of bits b0 through b5 stemming from the gradation data D1 and D2. One end of the series circuits C0 through C63 is supplied with reference voltages V0 through V63 respectively. The other end of the series circuits C0 through C63 is connected to a column line OUT. FIG. 3 shows a setup where the gradation data D1 and D2 occur in increments of six bits. The switching circuits are formed by conductive (N-channel/P-channel) MOS transistors. The N and P channels are disposed in such a manner that the switching circuits may select the reference voltages corresponding to the values of the gradation data D1. The digital-to-analog converters 3D and 4D are thus arranged to select and output the reference voltages V0 through V63 in keeping with the gradation data D1 and D2. FIG. 4 is a connection diagram showing switches replacing the transistors.

In the digital-to-analog converters 3D and 4D of the above-described structure, the other end of the series circuits C0 through C63 for selecting the reference voltages V0 through V63 is connected to the column line OUT of the display unit 2. The column line OUT is extended in the direction perpendicular to the sides along which the horizontal driving circuits 3 and 4 are disposed. The layout forms a block B (FIG. 4) of the series circuits C0 through C63 which are arranged in the vertical direction and which correspond to one pixel. Such blocks B are disposed continuously in the horizontal direction parallel to those sides of the display unit 2 along which the horizontal driving circuits 3 and 4 are located. In this layout, the reference voltages V0 through V63 are set for common use by the horizontally continuous blocks B by way of horizontally extended lines. The liquid crystal display device 1 is arranged in this manner to make the most of limited space on the substrate.

The odd-numbered and even-numbered columns are formed by the pixels for red, blue and green colors laid out one after another. In this setup, the horizontally continuous blocks B are assigned cyclically to the driving of the red, blue and green pixels. The blocks B are laid out at twice the repeating pitch P for the pixels.

If the series circuit blocks B are disposed in a manner corresponding to the repetitive pixels for the red, blue and green colors, if the blocks B are fed commonly with the reference voltages V0 through V63, and if there are N gradations provided by the reference voltages V0 through V63, then it is possible to give displays in N×N×N colors. In that case, the gradation data D1 and D2 corresponding to the reference voltages V0 through V63 permit displays in as many colors as 2 to the (3×n)th power where $N=2^n$. It follows that if the gradation data D1 and D2 occur in increments of six bits, it is possible to provide displays in about 260,000 colors.

However, portable terminal apparatuses are generally not required to give displays in as many as 260,000 colors. Typically, the gradation data D1 and D2 are set to be furnished in increments of six bits for the green color and in increments of five bits for the red and blue colors. This gives 64×32×32 colors (approximately 65,000 colors).

That means the conventional liquid crystal display device 1 described above with reference to FIGS. 1 through 4 has excess transistors included in the blocks B for the red and blue colors in the digital-to-analog converters 3D and 4D. The extra transistors are bound to dissipate power wastefully.

Removing these superfluous transistors provides two major benefits: the area occupied by the framework structure of the display unit 2 containing the excess transistors is made smaller, and the electric power consumption of the device is reduced correspondingly.

DISCLOSURE OF INVENTION

The present invention has been made in view of the above circumstances and provides a flat display apparatus that consumes less power and has a leaner framework than before, as well as a portable terminal apparatus incorporating that flat display apparatus.

According to one embodiment of the present invention, there is provided a flat display apparatus having a display unit and driving circuits formed integrally on a substrate, the display unit having pixels laid out in a matrix, the driving circuits driving the pixels of the display unit, the flat display apparatus including: a first gradation setting circuit which, as part of the driving circuits, is disposed along one side of the display unit and which sets gradations of the pixels for the green color; and a second gradation setting circuit which, as part of the driving circuits, is disposed along another side of the display unit and which sets gradations of the pixels for the red and blue colors, the other side being positioned opposite to that one side.

The embodiment of the invention, as outlined above, incorporates the first and the second gradation setting circuits. The first gradation setting circuit as part of the driving circuits is disposed along one side of the display unit in order to set gradations of the pixels for the green color. The second gradation setting circuit as part of the driving circuits is disposed along another side of the display unit so as to set gradations of the pixels for the red and blue colors, the other side being positioned opposite to that one side. The first and the second gradation setting circuits are structured in a manner reflecting the gradation count of the pixels for the green color and that of the pixels for the red and blue colors, respectively. Where the number of red and blue gradations is to be made smaller than the number of green gradations, the layout makes it possible to eliminate superfluous parts from the second gradation setting circuit. This translates into a reduced level of electric power consumption of the flat display apparatus and leads to narrowing of the display apparatus framework.

According to another embodiment of the present invention, there is provided a portable terminal apparatus using a flat display apparatus having a display unit and driving circuits formed integrally on a substrate, the display unit having pixels laid out in a matrix, the driving circuits driving the pixels of the display unit, the flat display apparatus including: a first gradation setting circuit which, as part of the driving circuits, is disposed along one side of the display unit and which sets gradations of the pixels for a green color; and a second gradation setting circuit which, as part of the driving circuits, is disposed along another side of the display unit and which sets gradations of the pixels for red and blue colors, the other side being positioned opposite to that one side.

With the above embodiment of the invention, it is also possible to reduce electric power consumption of the flat display apparatus and to narrow its framework. This translates into a portable terminal apparatus which, using the flat display apparatus, is made smaller in size and less power-consuming than before.

BEST MODE FOR CARRYING OUT THE INVENTION

Preferred embodiments of the present invention will now be described with reference to the accompanying drawings.

(1) First Embodiment

(1-1) Structure of the First Embodiment

Figure 5:
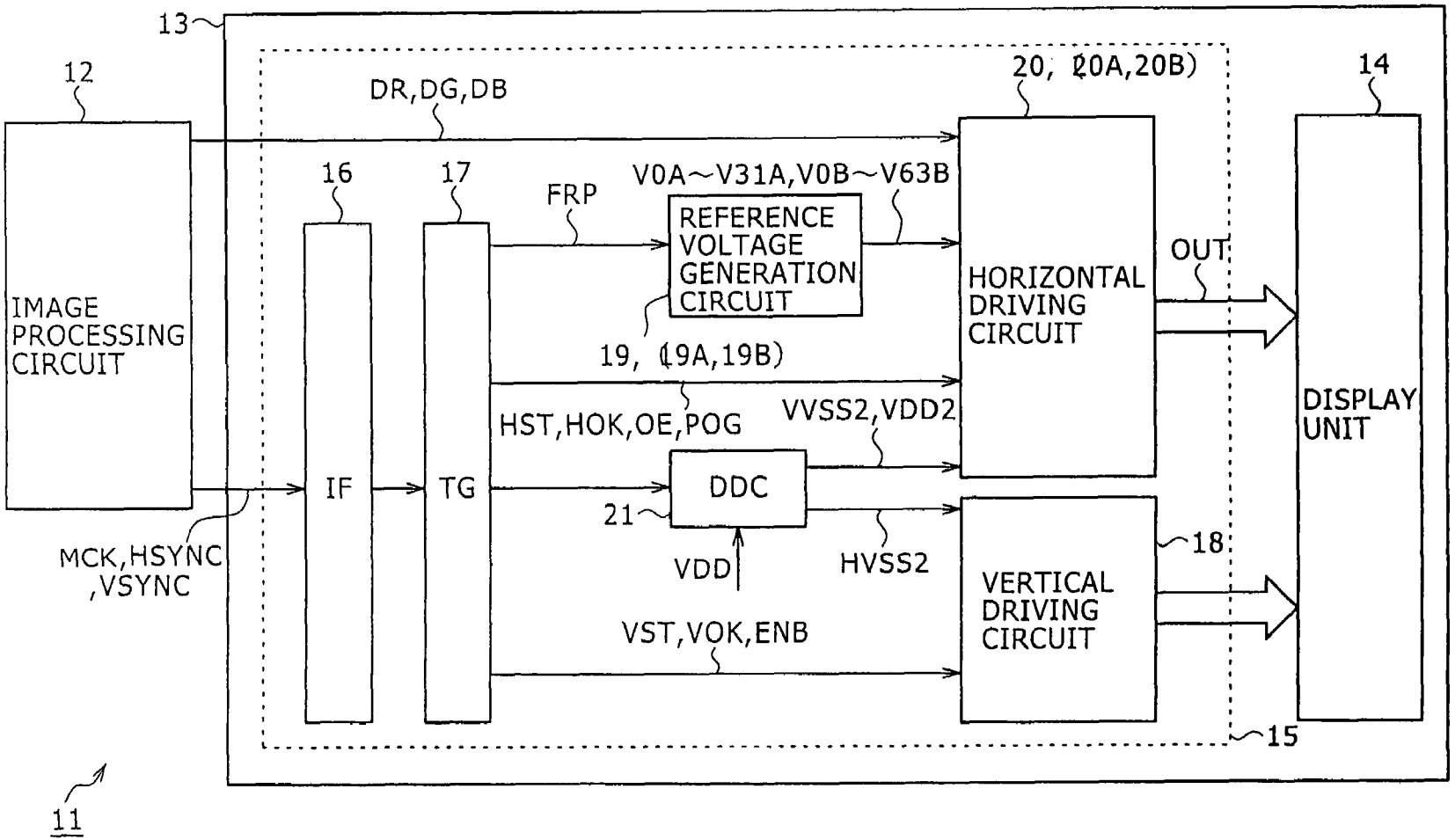
FIG. 5 is a block diagram of a portable terminal apparatus practiced as a first embodiment of this invention incorporating a liquid crystal display unit.

FIG. 5 is a block diagram of a portable terminal apparatus practiced as the first embodiment of this invention highlighting a picture display unit. The portable terminal apparatus is illustratively a mobile phone or a PDA. The picture display unit 11, designed to display desired pictures, has an image processing circuit 12 incorporating an image memory that accommodates image data DR, DG and DB. The image data DR, DG, and DB are output successively to a liquid crystal display device 13. In synchronism with output of the image data DR, DG and DB, the image processing circuit 12 outputs a master clock signal MCK, a vertical synchronizing signal VSYNC and a horizontal synchronizing signal HSYNC.

The inventive portable terminal apparatus inputs the image data DR, DG and DB, as well as the master clock signal MCK, vertical synchronizing signal VSYNC and horizontal synchronizing signal HSYNC to the internal liquid crystal display device 13 which in turn displays pictures. The liquid crystal display device 13 is a flat display apparatus constituted by a display unit 14 having pixels disposed in a matrix and by a driving circuit 15 for driving the pixels of the display unit 14, the display unit 14 and driving circuit 15 being disposed integrally on a glass substrate. With this embodiment, the pixels of the display unit 14 are constituted by liquid crystal cells, by polysilicon TFT's for switching the liquid crystal cells, and by auxiliary capacitors.

The driving circuit 15 has the master clock signal MCK, vertical synchronizing signal VSYNC, and horizontal synchronizing signal HSYNC input to a timing generator (TG) 17 through an interface (IF) 16. In turn, the timing generator 17 generates various timing signals for operation reference purposes. Acting on relevant timing signals coming from the timing generator 17, a DC-DC converter (DDC) 21 generates power supplies VDD2, VVSS2, and HVSS2 derived from a power source VDD fed to the liquid crystal display device 13. The power supplies thus generated are needed for activating diverse components.

Acting likewise on relevant timing signals from the timing generator 17, a vertical driving circuit 18 outputs selection signals for selecting lines of the display unit 14. A reference voltage generation circuit 19 generates reference voltages necessary for processing by a horizontal driving circuit 20. The horizontal driving circuit 20 sets gradations for those pixels of the display unit 14 which correspond to gradation data derived from the image data DR, DG and DB.

Figure 6:
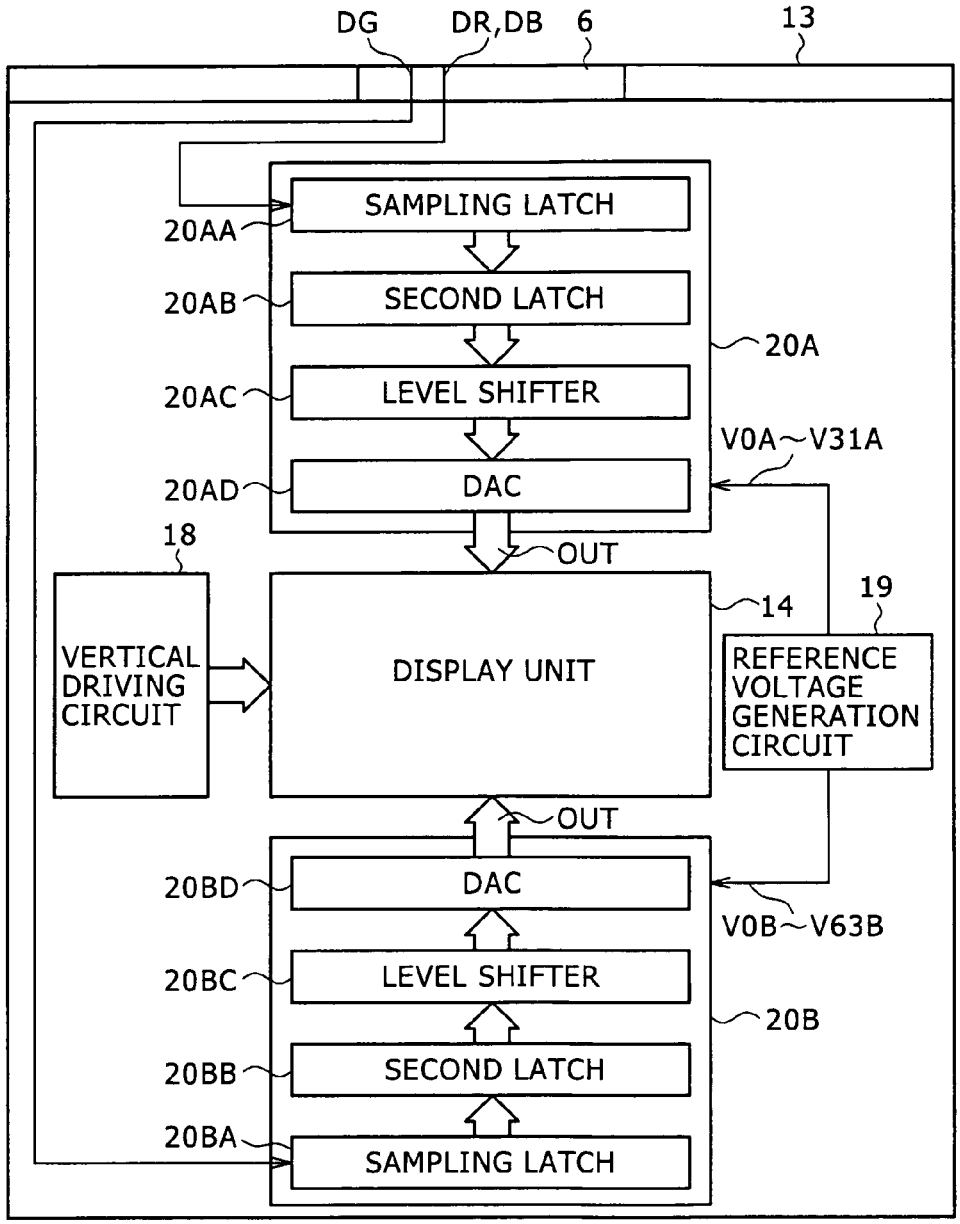
FIG. 6 is a plan view of the liquid crystal display unit included in the portable terminal apparatus of FIG. 5.

FIG. 6 is a plan view detailing a typical layout of the horizontal driving circuit 20, vertical driving circuit 18, and display unit 14 in the liquid crystal display device 13. This liquid crystal display device 13 admits in increments of five bits the image data DR and DB representing red and blue gradations while receiving in increments of six bits the image data DG denoting green gradations. The horizontal driving circuit 20 is made up of a horizontal driving circuit 20A for the red and blue colors and a horizontal driving circuit 20B for the green color.

The horizontal driving circuit 20A for the red and blue colors is disposed along the upper horizontal side of the display unit 14. The horizontal driving circuit 20B for the green color is laid out along the lower horizontal side of the unit 14 opposite to the upper side along which the horizontal driving circuit 20A is arranged.

In the liquid crystal display device 13, as described, the display unit 14 is flanked from up and down by the horizontal driving circuits 20A and 20B respectively. The horizontal driving circuit 20A acts as a gradation setting circuit that sets gradations for the display unit 14 using the gradation data DR and DB in five bits. The horizontal driving circuit 20B serves as a gradation setting circuit that sets gradations for the display unit 14 using the gradation data DG in six bits. The circuits thus laid out eliminates superfluous structures, thereby reducing electric power consumption correspondingly and contributing to narrowing of the display framework.

The horizontal driving circuit 20A for the red and blue colors has basically the same structure as the horizontal driving circuit 3 discussed above with reference to FIG. 1. The difference between the two circuits is threefold: the gradation data derived from the image data DR and DB subject to processing is for red and blue gradations; the circuit 20A as a whole is structured to deal with five-bit gradation data; and column line connections are arranged in such a manner as to output the driving signals corresponding to the red and blue pixels to the display unit 14. The reference voltage generation circuit 19 thins out six-bit reference signals V0B through V63B to be output to the horizontal driving circuit 20B, in order to output five-bit reference signals V0A through V31A to the horizontal driving circuit 20A.

More specifically, the horizontal driving circuit 20A causes a plurality of latching elements constituting a sampling latch 20AA to latch cyclically the five-bit image data DR and DB for the red and blue colors, the data being input in the raster scan sequence. The horizontal driving circuit 20A further causes a second latch 20AB to latch a plurality of latched results from the sampling latch 20AA in a concurrent and parallel manner on a line-by-line basis. A level shifter 20AC downstream of the second latch 20AB level-shifts signal levels of the data bits for analog-to-digital conversion by a digital-to-analog converter (DAC) 20AD. In this manner, the horizontal driving circuit 20A generates line by line a driving signal OUT for setting the gradations of the red and blue pixels. These components constitute a second gradation setting circuit that establishes the gradations for the red and blue pixels of the display unit 14.

Figure 1:
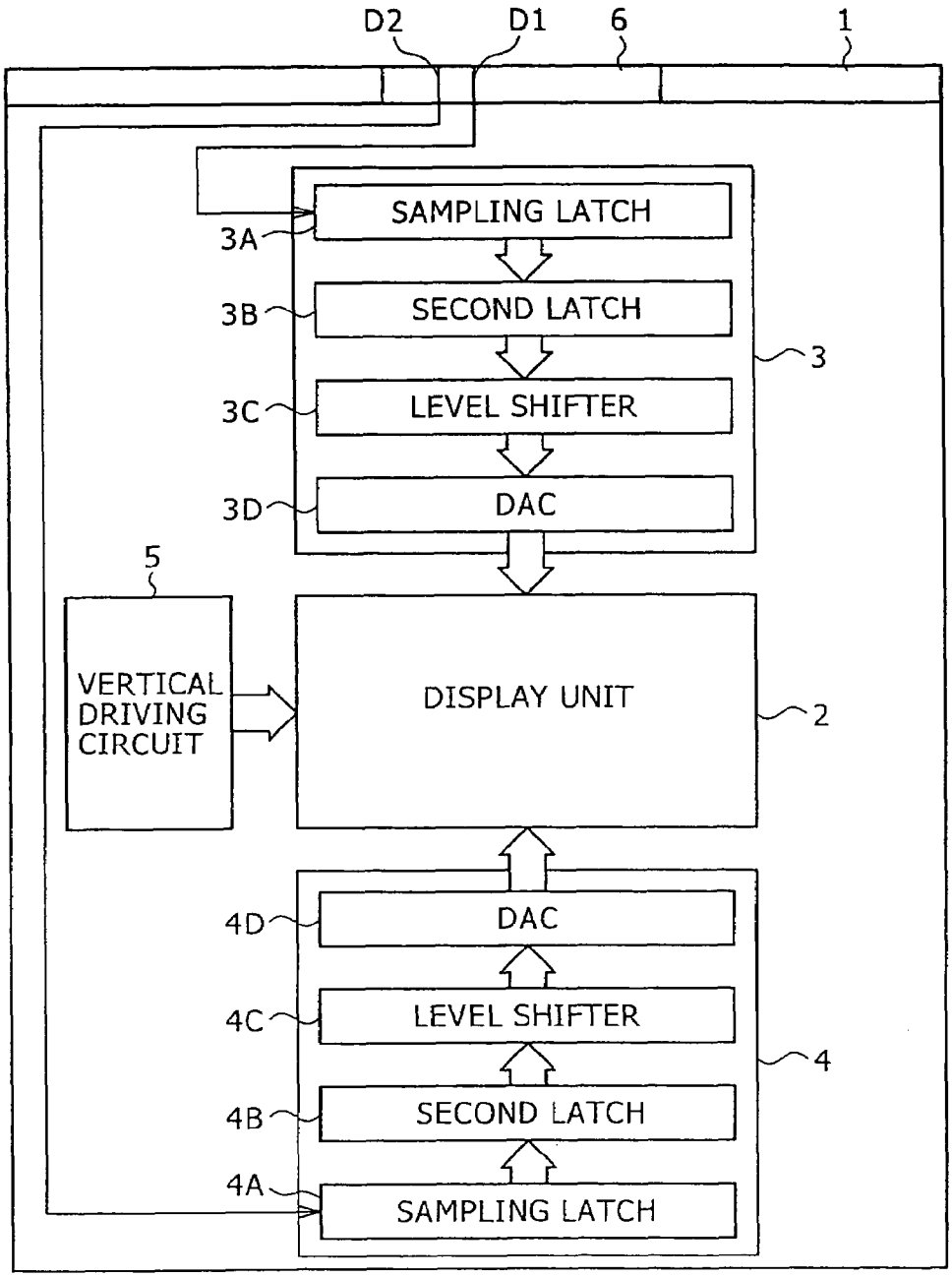
FIG. 1 (PRIOR ART)
FIG. 1 is a plan view outlining a conventional liquid crystal display device.
Figure 2:
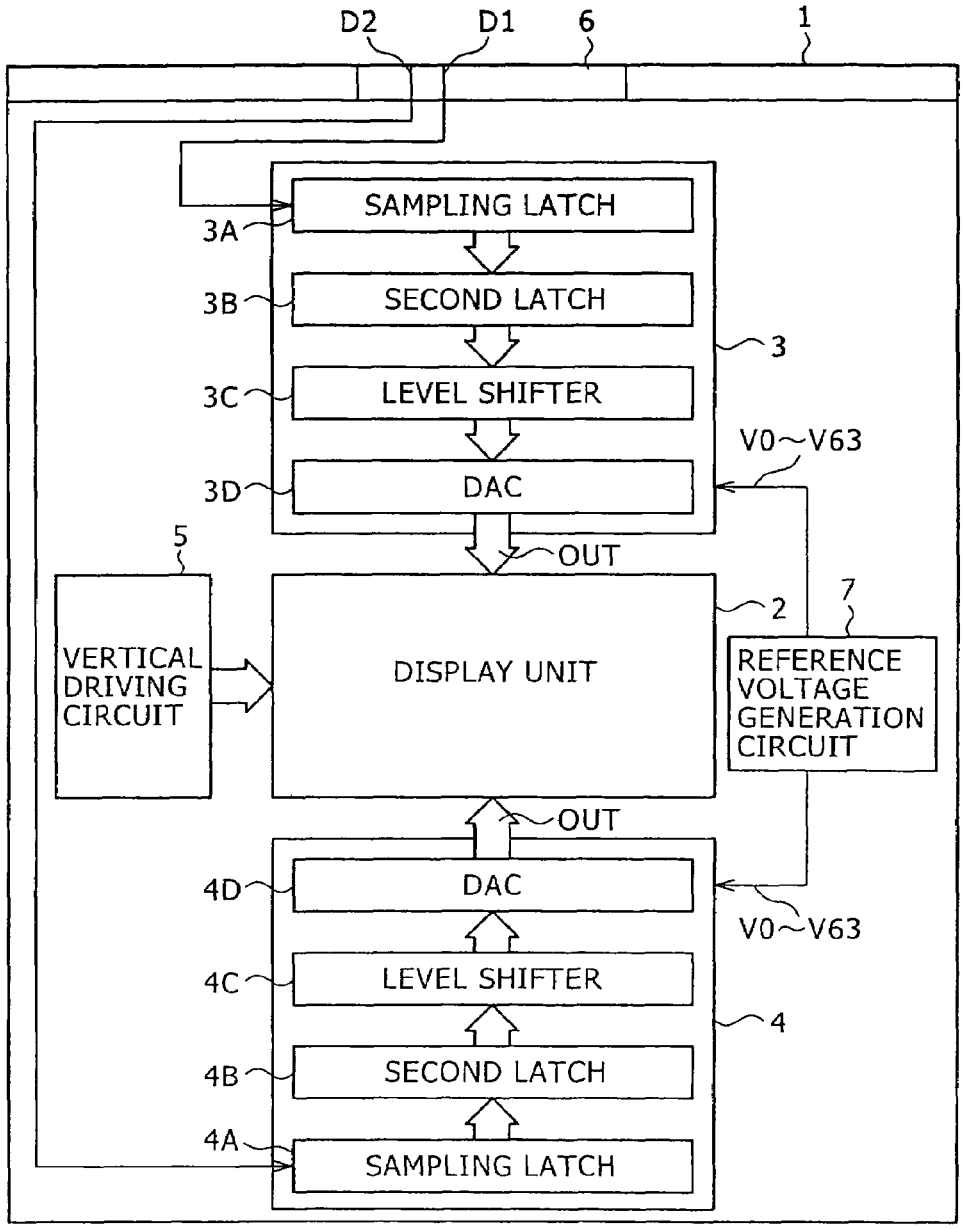
FIG. 2 (PRIOR ART)
FIG. 2 is a plan view showing how a reference voltage generation circuit is laid out.
Figure 3:
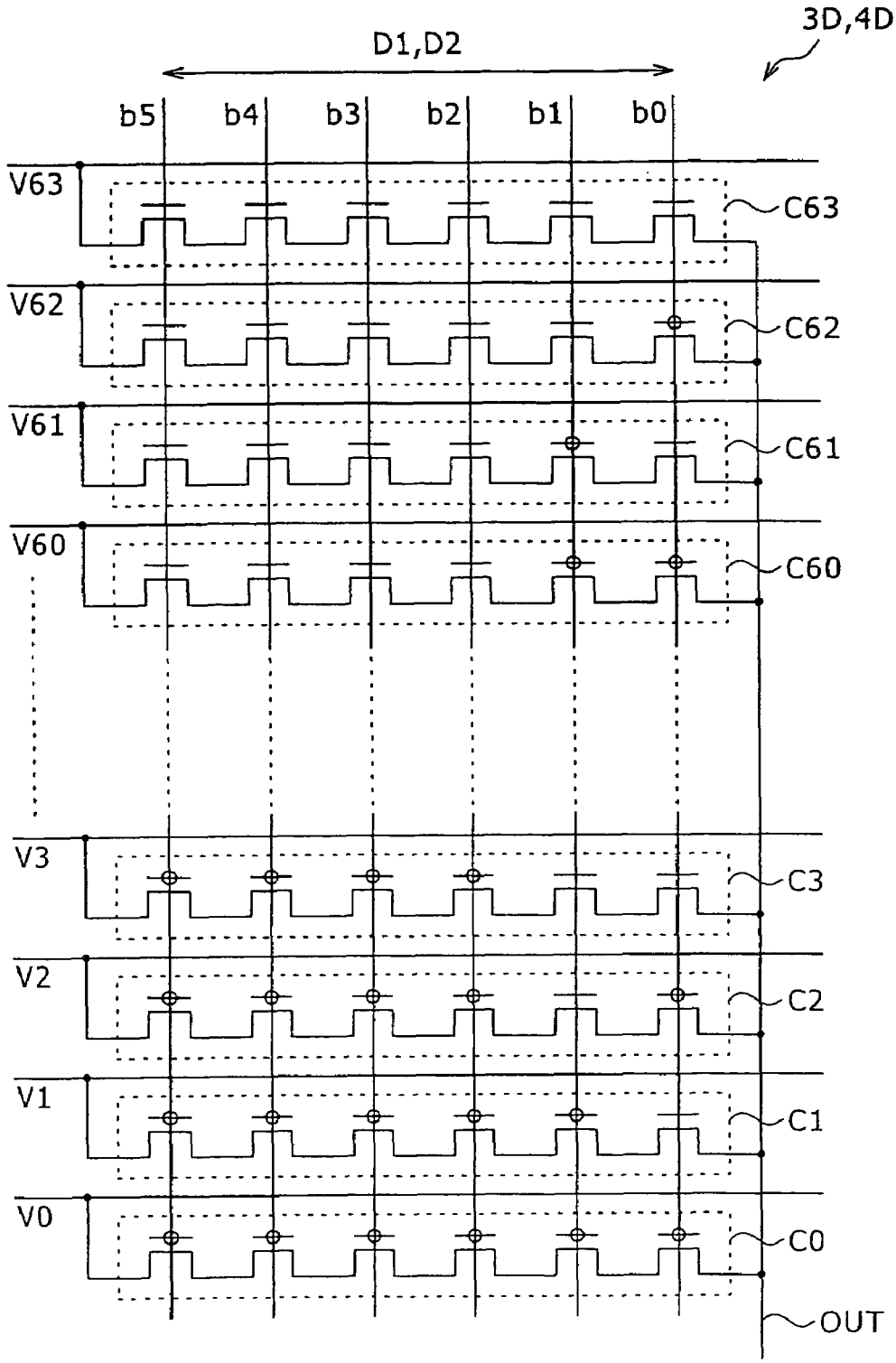
FIG. 3 (PRIOR ART)
FIG. 3 is a connection diagram of digital-to-analog converters included in the liquid crystal display device of FIG. 1.

Compared with the horizontal driving circuit 3 located above the display unit 2 in FIG. 1, the horizontal driving circuit 20A reduces the number of bits to be processed by the sampling latch 20AA, second latch 20AB, level shifter 20AC, and digital-to-analog converter (DAC) 20AD. This translates into a simplified device structure, contributing to narrowing of the display framework and lowering electric power consumption.

Figure 7:
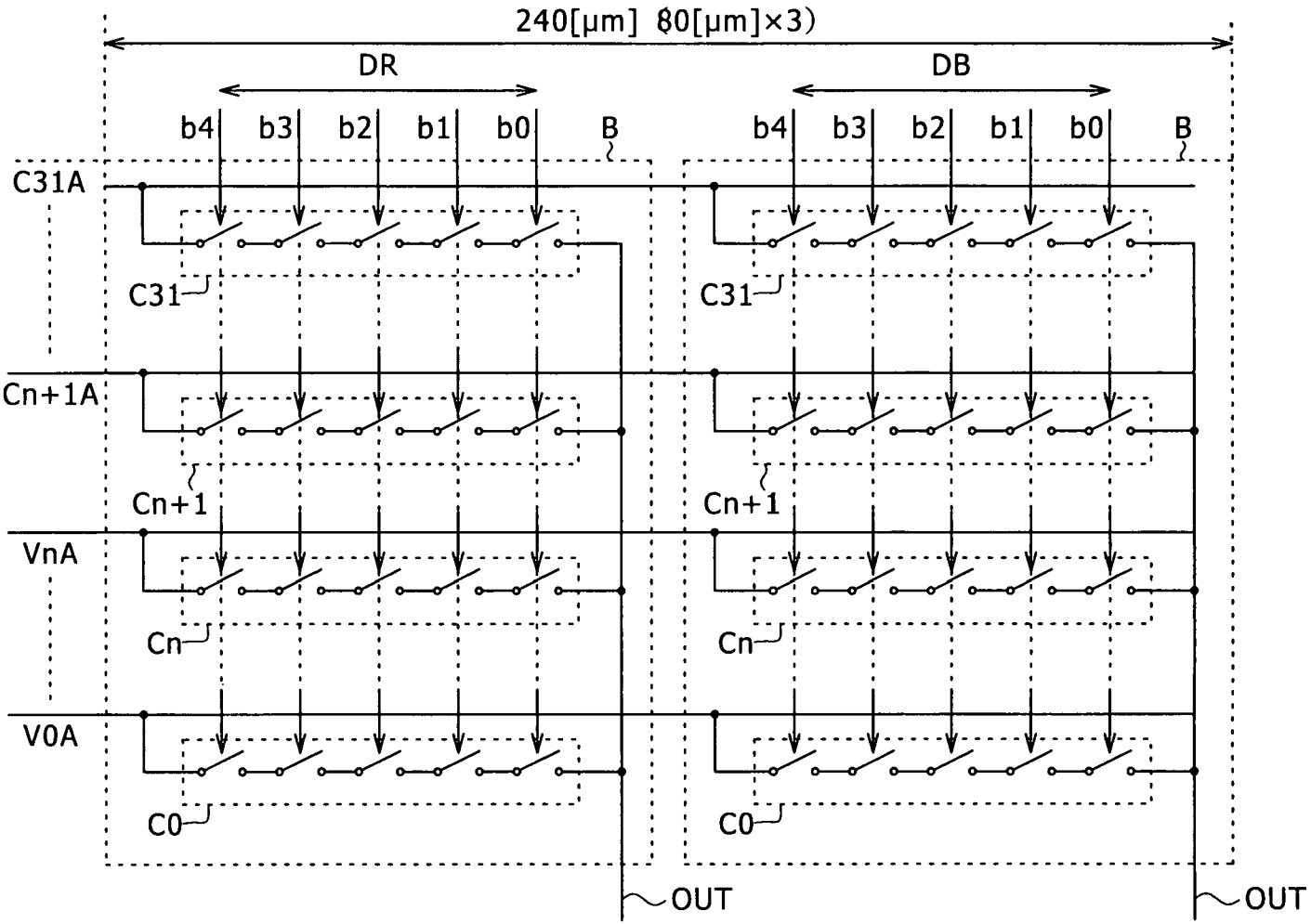
FIG. 7 is a connection diagram of a digital-to-analog converter 20AD in a horizontal driving circuit 20A as part of the liquid crystal display unit in FIG. 6.

FIG. 7 is a connection diagram of the digital-to-analog converter 20AD in the horizontal driving circuit 20A. In the digital-to-analog converter 20AD, P and N channel conductive MOS transistors make up switching circuits that are turned on and off depending on the logical values of the bits constituting the gradation data DR and DB. A plurality of series circuits C0 through C31 (i.e., 32 circuits) made up of these switching circuits are disposed in correspondence with the gradations to be provided by the horizontal driving circuit 20A.

One end of the series circuits C0 through C31 is connected to corresponding reference voltages V0A through V31A; the other end of the series circuits is connected to a column line. With these arrangements in place, the horizontal driving circuit 20A sets pixel gradations by causing the relevant series circuits to select the reference voltages corresponding to the gradations in question. The series circuits C0 through C31 are disposed in the direction of extended column lines so as to form blocks B each corresponding to one pixel. Whereas six-bit gradation data needs to be processed using 64 series circuits making up each block B, this embodiment dealing with five-bit gradation data requires only 32 series circuits per block for the processing. This permits a drastic narrowing of the framework in the upper part of the display unit 14.

Figure 4:
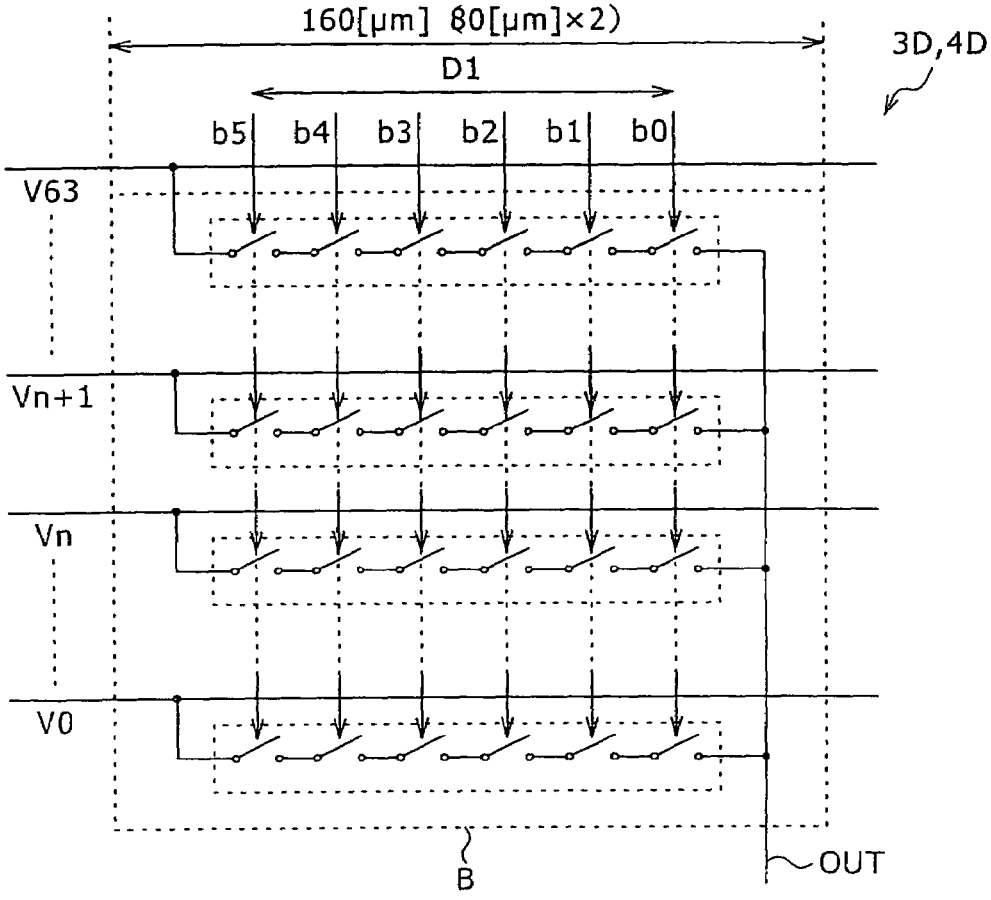
FIG. 4 (PRIOR ART)
FIG. 4 is a connection diagram showing switches that replace the transistors in FIG. 3.

When the horizontal driving circuit 20A is allocated for processing of the image data DR and DB for the red and blue colors, the horizontal driving circuit 20A needs to have the blocks B disposed at a higher density horizontally than for processing on the odd-numbered or even-numbered columns. As shown in FIG. 4, the processing on the odd-numbered or even-numbered columns requires disposing blocks B at twice the pitch of liquid crystal cells in the horizontal direction. If the pitch is 80 μm, then each block B needs to be 160 μm or less in width. Where the horizontal driving circuit 20A is allocated for processing of the image data DR and DB for the red and blue colors and where the pitch of liquid crystal cells is 80 μm in the horizontal direction, two blocks B need to be disposed over a width of 240 μm, which is three times the pitch. However, there have always been sufficient widths in the sideways direction. With its bit count made smaller, this embodiment has a more simplified sideways structure that accommodates the blocks B with no problem.

The horizontal driving circuit 20B for the green color is arranged to generate a driving signal OUT corresponding to the green pixels by successively processing the six-bit image data DG for the green color. More specifically, the horizontal driving circuit 20B causes a plurality of latching elements forming a sampling latch 20BA to latch cyclically the six-bit green image data DG being input in the raster scan sequence. A plurality of latched results from the sampling latch 20BA are latched concurrently and in parallel by a second latch 20BB on a line-by-line basis. A level shifter 20BC downstream of the second latch 20BB level-shifts signal levels of the data bits. The level-shifted signal levels are subjected to a digital-to-analog converter (DAC) 20BD for digital-to-analog conversion. In this manner the horizontal driving circuit 20B generates line by line a driving signal OUT for setting the gradations for the green pixels in the display unit. The horizontal driving circuit 20B thus acts as a first horizontal driving circuit that sets the gradations for the green pixels in the display unit.

As described, the horizontal driving circuit 20B processing only the gradation data for the green color drives a smaller number of pixels than in the processing on the odd-numbered or even-numbered columns. That means the density of cells in the horizontal direction is reduced. This embodiment takes advantage of the reduced density in the horizontal direction in implementing a narrowed framework structure.

Figure 8:
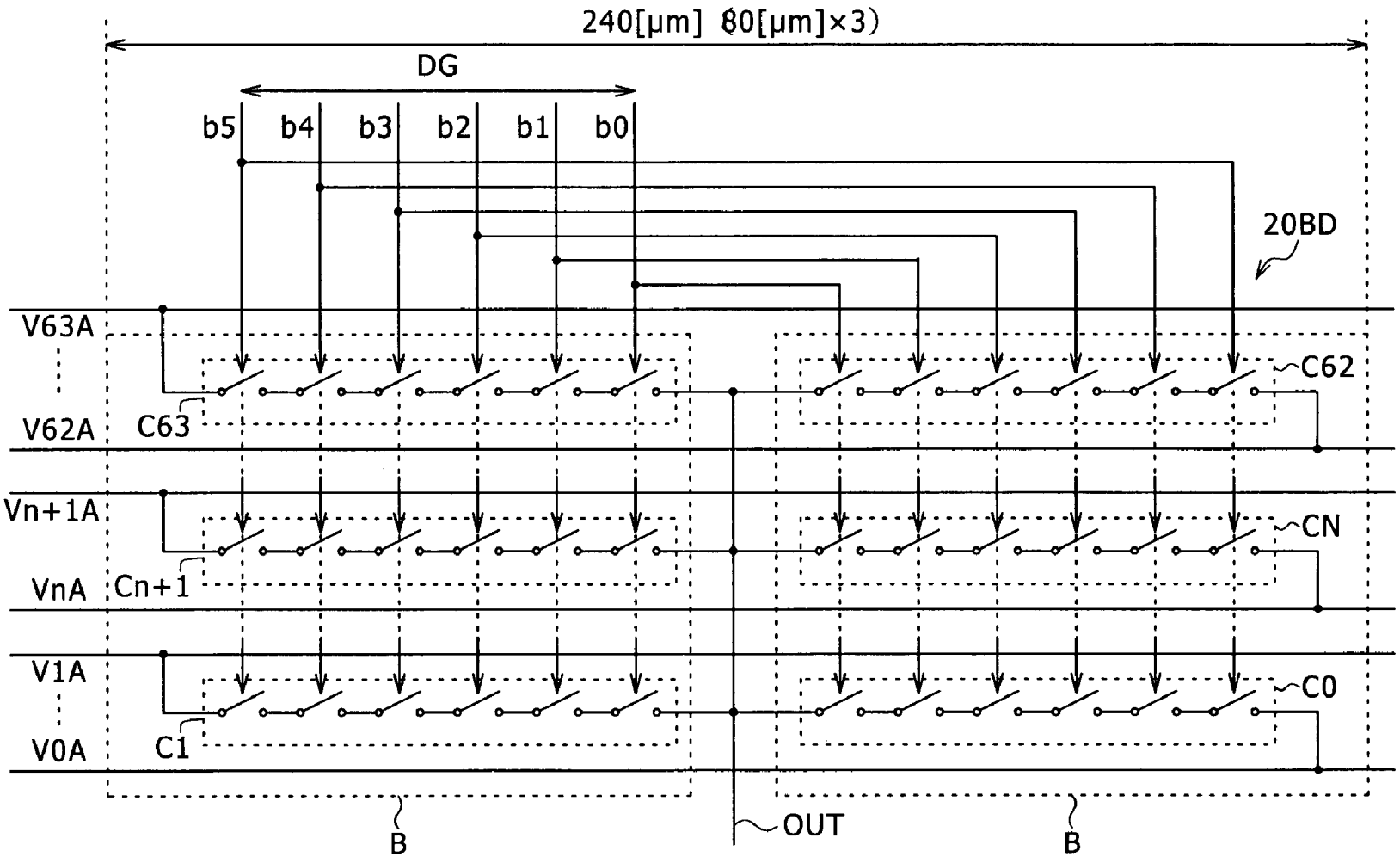
FIG. 8 is a connection diagram of a digital-to-analog converter 20BD in a horizontal driving circuit 20B as part of the liquid crystal display unit in FIG. 6.

FIG. 8 is a connection diagram of the digital-to-analog converter 20BD in the horizontal driving circuit 20B for the green color. In the digital-to-analog converter 20BD, as in the digital-to-analog converter 20AD, P and N channel conductive MOS transistors make up switching circuits that are turned on and off depending on the logical values of the bits constituting the gradation data DG. A plurality of series circuits C0 through C63 (i.e., 64 circuits) made up of these switching circuits are disposed in correspondence with the gradations to be provided by the horizontal driving circuit 20A.

One end of the series circuits C0 through C63 is connected to corresponding reference voltages V0A through V63A; the other end of the series circuits is connected to a column line. With these arrangements in place, the horizontal driving circuit 20B sets pixel gradations by causing relevant ones of the series circuits C0 through C63 to select the reference voltages V0A through V63A corresponding to the gradations based on the gradation data DG. The series circuit C0 is paired with the circuit C1, the circuit C2 paired with C3, etc., up to the circuit C63 paired with the circuit C63, each pair being formed horizontally as a unit and flanking the column line. The units are laid out in the extended column line direction to form blocks B each corresponding to one pixel. With this embodiment, each pair of series circuits arranged sideways is established as a series circuit for selecting an adjacent reference voltage.

With the above arrangements in place, the horizontal driving circuit 20B of this embodiment outputs 64-gradation driving signals based on the six-bit gradation data DG, but has only 32 series circuits disposed in the extended common line direction as in the case of the digital-to-analog converter 20AD in the horizontal driving circuit 20A for processing the five-bit gradation data DR and DB. This means that the framework structure located under the display unit 14 is streamlined just as effectively.

(1-2) Operation of the First Embodiment

In the portable terminal apparatus of the above-described structure (FIG. 5), the internal image memory of the image processing circuit 12 holds image data acquired by accessing websites as well as image data obtained through image pickup means of the apparatus. The image data kept in the image memory is input to the liquid crystal display device 13 along with synchronizing signals. Whereas the green image data DG is acquired in six bits and placed into the image memory before being output therefrom, the red and blue image data DR and DB are obtained in five bits and stored into the image memory before their output. The inventive portable terminal apparatus is thus made up of a simplified series of processing blocks for processing image data furnished in numbers of bits corresponding to the gradations sufficient for displaying the image data in question.

The horizontal driving circuit 20 converts the image data DR, DG and DB thus input into the driving signals corresponding to the gradations of the pixels. After the conversion, the driving signals are output to the display unit 14. The vertical driving circuit 18 selects lines so that the driving signals are fed to the pixels of the selected lines. This causes the display unit 14 to display pictures based on the image data DR, DG and DB.

Of the image data DR, DG and DB, the five-bit red and blue image data DR and DB (FIG. 6) are processed collectively by the horizontal driving circuit 20A in order to generate driving signals for the corresponding pixels, the circuit 20A being disposed along the upper side of the display unit 14. The remaining six-bit green image data DG is processed collectively by the horizontal driving circuit 20B so as to generate driving signals for the corresponding pixels, the circuit 20B being located along the upper side of the display unit 14. This layout of the liquid crystal display device 13 allows the horizontal driving circuit 20A on the upper side of the display unit 14 to be so structured as to handle five-bit data. As a result, superfluous structures are eliminated, electric power consumption is lowered, and the display framework is streamlined. (FIG. 7)

Illustratively, the digital-to-analog converter 20AD has a plurality of series circuits disposed corresponding to gradations, each of the series circuits being made up of switching circuits that are turned on and off depending on the logical values of the image data bits constituting gradation data for designating the gradations in question. The reference voltages corresponding to the gradations of interest are selected by the relevant series circuits in keeping with the gradation data, whereby the pixel gradations are established. The series circuits are arranged perpendicular to the upper side of the display unit 14 to form blocks B each representing one pixel. When the blocks B are disposed side by side along the upper side of the display unit 14, the number of series circuits making up the blocks B is reduced to half that of the typical conventional setup. This makes it possible to narrow the display framework.

Meanwhile, the six-bit type horizontal driving circuit 20B for the green color disposed along the lower side of the display unit deals with only one stream of image data DG, as opposed to the upper-side horizontal driving circuit 20A that deals with two streams of image data DR and DB for the red and blue colors. The arrangement thus provides sufficient room in the horizontal direction. For that reason, as shown in FIG. 8, the digital-to-analog converter 20BD of this embodiment uses the paired series circuits to select corresponding reference voltages based on the gradation data, each pair of series circuits being disposed horizontally to constitute a unit. The units are arranged in the extended column line direction to form a block B corresponding to one pixel. In turn, the blocks B are laid out horizontally in such a manner that the number of series circuit rows is reduced to half that of the conventional type, whereby the display framework is streamlined.

(1-3) Effects of the First Embodiment

With the first embodiment, as described above, the horizontal driving circuit 20B for the green color is disposed along one of two opposing sides of the display unit 14, and the horizontal driving circuit 20A for the red and green colors is furnished along the other side of the display unit. The circuits 20A and 20B are structured to comply with the number of bits in image data so that superfluous structures are eliminated, with the level of electric power consumption made lower and with the display framework rendered narrower than before.

More specifically, when the number of gradations set by the horizontal driving circuit 20B for the green color is made larger than the number of gradations set by the horizontal driving circuit 20A for the red and green colors, each of the circuits 20A and 20B is arranged to comply with the number of bits in image data so as to avert excess structures. The arrangement makes power consumption lower and the display framework narrower than before.

In the horizontal driving circuit 20B for the green color, the series circuits made up of switches for selecting reference voltages are turned into pairs each constituting a unit. The units are arranged in the extended column line direction to form blocks B each corresponding to one pixel. This arrangement of the horizontal driving circuit 20B for the green color promotes narrowing of the display framework as well.

(2) Second Embodiment

Figure 9:
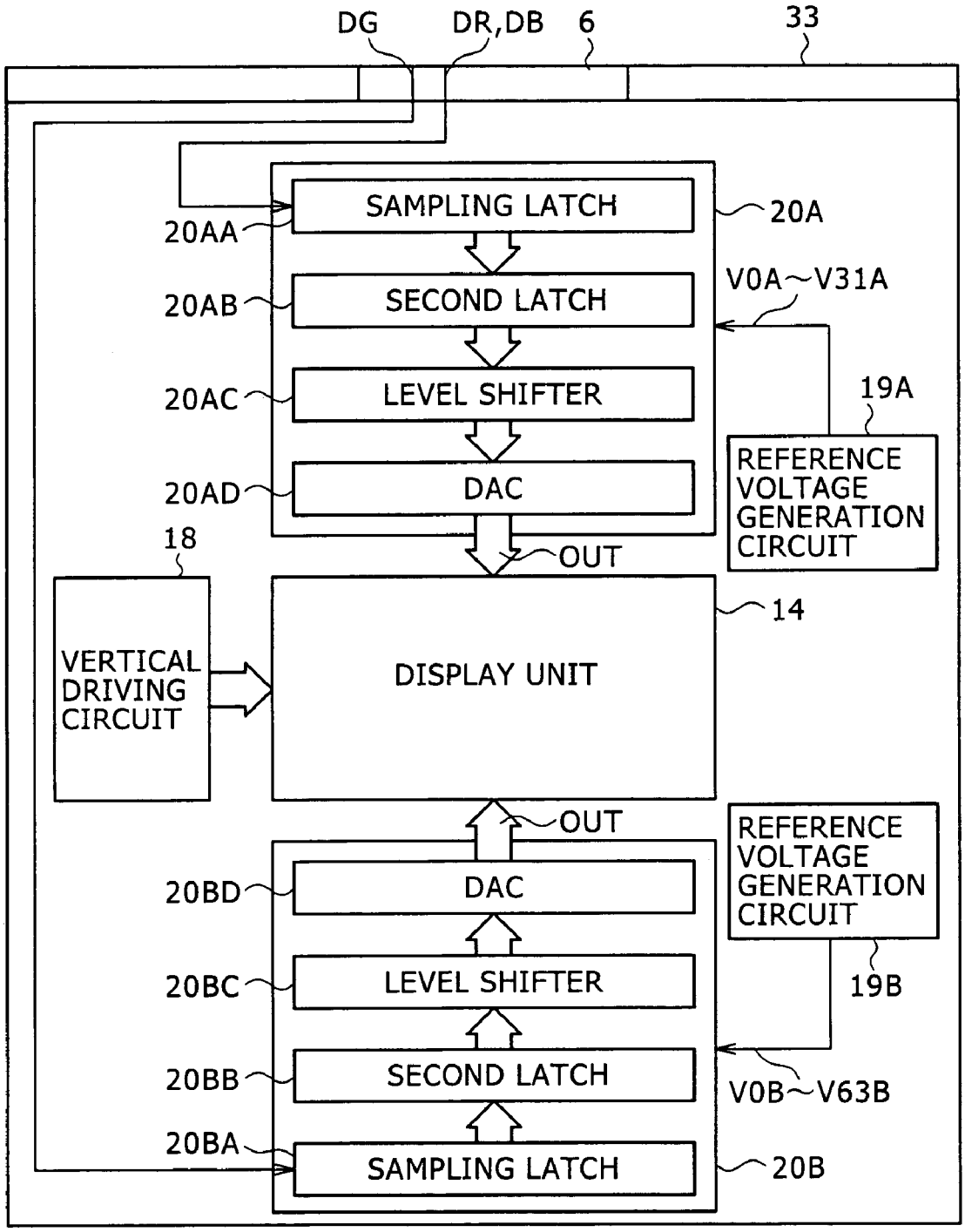
FIG. 9 is a plan view of a portable terminal apparatus practiced as a second embodiment of this invention incorporating a liquid crystal display unit.

FIG. 9 is a plan view of a liquid crystal display device 33 applied to a portable terminal apparatus practiced as the second embodiment of this invention in contrast to the setup in FIG. 6. In the liquid crystal display device 33, a reference voltage generation circuit 19A disposed close to a five-bit type horizontal driving circuit 20A generates reference signals V0A through V31A corresponding to five-bit gradations, and supplies the generated signals to the horizontal driving circuit 20A. A reference voltage generation circuit 19B laid out close to a six-bit type horizontal driving circuit 20B generates reference signals V0B through V63B corresponding to six-bit gradations, and feeds the generated signals to the horizontal driving circuit 20B. The second embodiment basically has the same structure as the first embodiment except for the constitutions of the reference voltage generation circuits 19A and 19B for generating reference signals.

In the second embodiment, the two reference voltage generation circuits are each located close to the corresponding horizontal driving circuit 20A or 20B so that spaces required for accommodating reference voltage wiring can be minimized, with the sideways structures streamlined to bring about a narrower display framework than before. With the horizontal driving circuits 20A and 20B arranged to comply with the red, blue and green pixels, the reference voltage generation circuits dedicated to these circuits help to avert vertical streaks that may occur on the display screen due to reference voltage fluctuations with the odd-numbered and even-numbered columns separately processed as explained earlier with reference to FIG. 1.

(3) Other Embodiments

While the embodiments above were shown handling five-bit and six-bit image data for displaying pictures, this is not limitative of the invention. The present invention may also be applied to many other cases where diverse numbers of bits are utilized. In particular, it is possible to practice this invention extensively when the number of bits for the blue color is different from that of bits for the red color.

Although the embodiments above were shown driving the pixels formed by liquid crystal cells, this is not limitative of the invention. Alternatively, the invention may be applied to varieties of flat display apparatuses with their pixels constituted by diverse kinds of displaying means.

According to the present invention, as described, a gradation setting circuit for the green color is disposed along one of two opposing sides of a display unit, and a gradation setting circuit for the red and blue colors is furnished along the other side of the display unit. The layout provides a lower level of electric power consumption and permits a narrower display framework than before.

INDUSTRIAL APPLICABILITY

The present invention relates to a flat display apparatus and a portable terminal apparatus. Illustratively, the invention may be applied to a liquid crystal display device, as well as to a PDA, a mobile phone or like equipment each using that liquid crystal display device.

The invention claimed is:

1. A flat display apparatus having a display unit and driving circuits formed integrally on a substrate, said display unit having pixels laid out in a matrix, said driving circuits driving the pixels of said display unit, said flat display apparatus comprising:

a first gradation setting circuit which, as part of said driving circuits, is disposed along one side of said display unit and which sets gradations of the pixels for a green color; and a second gradation setting circuit which, as part of said driving circuits, is disposed along another side of said display unit and which sets gradations of the pixels for red and blue colors, said another side being positioned opposite to said one side;

wherein said first and said second gradation setting circuits each include a plurality of series circuits corresponding to said gradations, each of said series circuits being formed by switching circuits turned on and off depending on logical values of bits making up gradation data for designating said gradations, said first and said second gradation setting circuits setting the gradations for said pixels by causing said series circuits to select reference voltages corresponding to said gradations on the basis of said gradation data;

wherein, in said first gradation setting circuit, pairs of series circuits each disposed along said one side constitute units arranged perpendicular to said one side in such a manner as to form blocks which correspond each to one of said pixels and which are positioned along said one side; and wherein, in said second gradation setting circuit, said series circuits are disposed perpendicular to said one side in such a manner as to form blocks which correspond each to one of said pixels and which are arranged along said one side.

2. The flat display apparatus according to claim 1, wherein the number of gradations set by said first gradation setting circuit is greater than the number of gradations set by said second gradation setting circuit.

3. The fiat display apparatus according to claim 1, wherein said first gradation setting circuit sets the gradations of said pixels for said green color by selecting first reference voltages generated by a first reference voltage generation circuit disposed close to said first gradation setting circuit on said substrate; and wherein said second gradation setting circuit sets the gradations of said pixels for said red and blue colors by selecting second reference voltages generated by a second reference voltage generation circuit disposed close to second gradation setting circuit on said substrate.

4. A portable terminal apparatus using a flat display apparatus according to claim 1.

* * * * *